US008701922B2

(12) United States Patent
Määttä et al.

(10) Patent No.: US 8,701,922 B2
(45) Date of Patent: Apr. 22, 2014

(54) COVER OF A PACKAGE, A METHOD FOR MANUFACTURING THE SAME AND A PACKAGE SEALED WITH A COVER AND A METHOD FOR SEALING A PACKAGE

(75) Inventors: Päivi Määttä, Imatra (FI); Tapani Penttinen, Huutjärvi (FI); Tommi Tuominen, Huutjärvi (FI)

(73) Assignee: Stora Enso OYJ, Helsinki (FI)

( * ) Notice: Subject to any disclaimer, the term of this patent is extended or adjusted under 35 U.S.C. 154(b) by 514 days.

(21) Appl. No.: 12/518,844

(22) PCT Filed: Dec. 5, 2007

(86) PCT No.: PCT/FI2007/050664
§ 371 (c)(1),
(2), (4) Date: Jul. 9, 2009

(87) PCT Pub. No.: WO2008/071838
PCT Pub. Date: Jun. 19, 2008

(65) Prior Publication Data

US 2010/0084299 A1 Apr. 8, 2010

(30) Foreign Application Priority Data

Dec. 12, 2006 (FI) ..... 20065795
May 14, 2007 (FI) ..... 20070204

(51) Int. Cl.
*B65D 41/00* (2006.01)

(52) U.S. Cl.
USPC ..... 220/359.3; 206/484.1

(58) Field of Classification Search
USPC ..... 206/461, 1.5, 484.1; 220/480–482, 220/495.03, 203.09, 213, 222, 257.2, 270, 220/269, 833, 835, 796, 802, 359.1–359.4, 220/62.13, 643, 203.08, 800, 801, 359.2, 220/359.3; 215/356, 345, 364, 50, 53, 54, 215/273, 274, 346; 493/328, 358; 53/477; 229/125.17, 125.09, 404
See application file for complete search history.

(56) References Cited

U.S. PATENT DOCUMENTS

| | | | | | |
|---|---|---|---|---|---|
| 937,238 | A | * | 10/1909 | Gross | 215/356 |
| 1,351,496 | A | * | 8/1920 | Spooner | 215/329 |
| 1,587,167 | A | * | 6/1926 | Marsden | 215/355 |
| 2,880,859 | A | * | 4/1959 | Tupper | 220/257.2 |

(Continued)

FOREIGN PATENT DOCUMENTS

| | | | |
|---|---|---|---|
| DE | 2534748 | A1 | 2/1977 |
| EP | 0665171 | A1 | 8/1995 |

(Continued)

*Primary Examiner* — Jacob K Ackun
*Assistant Examiner* — Jenine Pagan
(74) *Attorney, Agent, or Firm* — Birch, Stewart, Kolasch & Birch, LLP

(57) ABSTRACT

A cardboard cover that seals a package and that also enables the resealing of the package. The lower surface of the cover (2) is provided with a downwards directed annular profile (3) made of an injection mouldable material, which enables the resealing of the cover and is placed inside the package when the package is sealed. The invention also relates to a package which is sealed by using the above-described cardboard cover that enables resealing. The invention also relates to a method for manufacturing a card-board cover and a method for sealing a package.

14 Claims, 3 Drawing Sheets

(56) References Cited

U.S. PATENT DOCUMENTS

| | | | | | |
|---|---|---|---|---|---|
| 2,974,825 | A | * | 3/1961 | Bruce Ross | 220/789 |
| 3,204,359 | A | * | 9/1965 | Kurokawa | 40/307 |
| 3,391,852 | A | * | 7/1968 | Waldrop | 229/123.2 |
| 4,182,475 | A | * | 1/1980 | Freund | 229/5.7 |
| 4,346,833 | A | * | 8/1982 | Bernhardt | 220/257.1 |
| 4,427,148 | A | | 1/1984 | Seiter et al. | |
| 4,527,703 | A | * | 7/1985 | Cummings | 215/232 |
| 4,572,373 | A | * | 2/1986 | Johansson | 206/515 |
| 4,682,707 | A | * | 7/1987 | Wiles | 220/789 |
| 4,691,839 | A | | 9/1987 | Ullman | |
| 5,328,045 | A | * | 7/1994 | Yoshida | 220/359.2 |
| 5,582,317 | A | * | 12/1996 | Wermund | 220/789 |
| 5,803,248 | A | * | 9/1998 | Cox | 206/213.1 |
| 6,027,802 | A | * | 2/2000 | Lin | 428/343 |
| 6,302,321 | B1 | * | 10/2001 | Reese et al. | 229/123.1 |
| 6,688,486 | B2 | * | 2/2004 | Diamond et al. | 220/785 |
| 2004/0245138 | A1 | * | 12/2004 | Penttinen et al. | 206/484.1 |
| 2005/0089656 | A1 | | 4/2005 | Shiina | |
| 2005/0218143 | A1 | * | 10/2005 | Niederer et al. | 220/359.2 |
| 2005/0269236 | A1 | * | 12/2005 | Rohrmus et al. | 206/531 |

FOREIGN PATENT DOCUMENTS

| | | | |
|---|---|---|---|
| EP | 0 731 036 | B1 | 9/1998 |
| EP | 1 559 655 | A1 | 8/2005 |
| GB | 2 152 913 | A | 8/1985 |
| GB | 2350353 | A | 11/2000 |
| JP | 11-292116 | A | 10/1999 |
| JP | 2004-238048 | A | 8/2004 |
| WO | WO-03/033258 | A1 | 4/2003 |

* cited by examiner

COVER OF A PACKAGE, A METHOD FOR MANUFACTURING THE SAME AND A PACKAGE SEALED WITH A COVER AND A METHOD FOR SEALING A PACKAGE

FIELD OF THE INVENTION

The invention relates to a cardboard cover which makes it possible to reseal a package after it has been opened. The invention also relates to a method for manufacturing a cardboard cover that makes it possible to reseal a package. Furthermore, the invention relates to a package comprising a bottom part and a cardboard cover for sealing the package, connected to the bottom part, as well as a method for sealing such a package.

BACKGROUND OF THE INVENTION

The materials used in food packages are often plastic or cardboard-based materials with plastic or metal layers to add barrier properties. Food-containing packages normally have a structure with a bottom part containing the packed food and a cover part joined to the bottom part. The cover of the package often consists of two separate parts, one part intended for sealing the package tightly and the other part merely intended for resealing the package. The cover part for sealing the package tightly is normally film-like and it is removed completely when the package is opened, and after this, a separate plastic cover is used for resealing the package.

The film-like cover parts used for sealing the package are normally made of plastic, metal, or a cardboard-based material with plastic or metal layers for adding barrier properties, because a food package must, on one hand, be tightly sealable without affecting the general barrier properties of the package, but on the other hand, the package should be openable with relative ease later on.

For example publication WO 03/033258 discloses a heat-sealable package cover formed of a coated fibre material. Such a heat-sealable cardboard-based cover provides good sealing properties, and the cover is easily detachable from the package by tearing off. Such covers are normally used in food packages which are intended to be emptied at one time, but they are also used in connection with larger package sizes, and in this case, such a cardboard-based cover does not enable the resealing of the package. Consequently, a separate plastic cover must be used for resealing.

It is expensive to use such two-piece covers described above, because it increases, among other things, the need for materials, and such a cover structure is normally used in non-returnable packages. Another problem with separate plastic covers is how to keep them attached to the package during transportation. Thus, a simple and inexpensive cover structure which would enable both the tight sealing and resealing of the cover would be desirable. Furthermore, the sealing of food packages should be easy to include in the industrial food packaging process.

BRIEF SUMMARY OF THE INVENTION

It is an aim of the present invention to disclose a cardboard cover which enables the tight sealing of a package and, after the opening, the resealing of the package by using the same cover. Thus, a separate cover intended for resealing the package will no longer be needed.

To achieve this aim, the cardboard cover according to the invention is primarily characterized in that the lower surface of the cardboard cover is provided with a downwards directed annular profile made of an injection mouldable material, which is placed inside the package when the package is sealed.

The cover according to the invention is made of a cardboard or paper based material which is coated on at least one side to achieve sufficient barrier properties. The downwards directed narrow annular profile on the lower surface of the cover is made of an injection mouldable plastic material, and to support the structure of the profile, the inner surface of the profile is equipped with ribs. The outer surface of the profile may be flat, or alternatively, threads or a sealing mechanism enabling a snap-on connection can be formed on the outer surface of the profile.

The cover according to the invention is particularly suitable for sealing packages made of cardboard or paper, but it is also suitable for sealing packages made of a plastic material.

Another aim of the invention is to disclose a method for manufacturing such a cardboard cover that enables the sealing and resealing of a package. The method according to the invention for manufacturing the cardboard cover for sealing a package is primarily characterized in that a downwards directed annular profile is formed by injection moulding on the lower surface of the cardboard cover.

Furthermore, it is an aim of the invention to disclose a package sealed with a cardboard cover according to the invention, enabling the resealing of the package. Another aim of the invention is to disclose a method for sealing a package which provides very good sealing at the seam between the bottom part and the cover part of the package but the package is still easy to open and the method can be easily included in the industrial food packaging process.

The package according to the invention, comprising a bottom part and, attached to it, a cardboard cover that seals the package and enables the resealing of the package, as well as a product packed in the inner space limited by them, is primarily characterized in that it is closed with the above-described cover according to the invention, which is resealable after the opening so that the downwards directed annular profile made of an injection mouldable material on the lower surface of the cover is placed inside the bottom part of the package. A sealing mechanism can be formed on outer surface of the profile on the lower surface of the cover, wherein a counter-piece for the sealing mechanism in the profile of the cover is provided inside the bottom part of the package so that the sealing of the package is possible after the opening, by using the same cover. The package according to the invention is preferably cup-shaped, but the cover according to the invention is also suitable for packages with other shapes.

The method according to the invention for sealing a package is primarily characterized in that the above-described cover according to the invention can be attached to the bottom part of the package by sealing with a plastic material. The sealing can be performed, for example, by means of heat-sealing, ultrasonic sealing, or a laser.

The package according to the invention is easy to seal by the above-mentioned sealing methods which provide a tight sealing required for food packages but still a sealing that is easy to open. To secure this property, a separate thin plastic layer is formed in the area between the downwards directed profile in the lower surface of the cover and the outer edge of the cover, or the so-called sealing area. This layer is made of a sealable plastic material, and the selection of the plastic material used is made according to the sealing method to be used for sealing the package. The addition of this layer onto the lower surface of the cover is not compulsory if the cardboard or paper cover has already been coated with a sealable material.

The thin plastic layer added onto the cover or the downwards directed profile on the lower surface of the cover may also contain an additive that absorbs laser radiation, in which case a laser can be used for sealing the package. The opening of the cover can also be facilitated by adding a lacquer, a wax or another corresponding substance onto the sealing area.

The cover according to the invention makes it possible to close the package by sealing, wherein the coating layer or extra plastic layer on the lower surface of the cover is sealed to the opening roll or flange of the bottom part of the package, and furthermore, the resealing of the package is possible by means of the profile on the lower surface of the cover. The package with a cover according to the invention can thus be sealed tightly in a single step with a single cover which is simultaneously the cover intended for resealing the package. The cover can be attached tightly to the package, and it does not contain parts that are easily detached during transportation.

The cardboard cover according to the invention can be used for sealing larger packages than before, because the downwards directed profile in the cover also makes the package more rigid, particularly if the package is made of a cardboard or paper based material. Furthermore, various printings, such as dates and instructions for use, are more stable on a cover made of a cardboard or paper based material than on a plastic cover.

The package according to the invention can be used particularly for the packaging of foods, but a package whose profile is equipped with a special sealing mechanism is also suitable for use, for example, as a drug package.

BRIEF DESCRIPTION OF THE DRAWINGS

In the following, the invention will be described in more detail with reference to the appended drawings, in which.

DETAILED DESCRIPTION OF THE INVENTION

Figure 1:
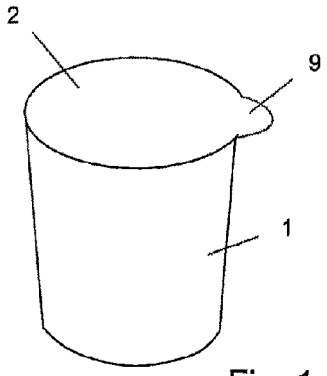
FIG. 1 shows a cup-like package sealed with a cover according to the invention.

FIG. 1 shows a cup-like package whose bottom part 1 is sealed with a planar cover 2. The cover 2 comprises a flap 9 that facilitates the tearing off of the cover 2 from the bottom part 1. The package does not necessarily need to a have the tearing flap 9 to facilitate the opening; its necessity will depend on the sealing mechanism in the profile 3 of the cover.

Figure 2:
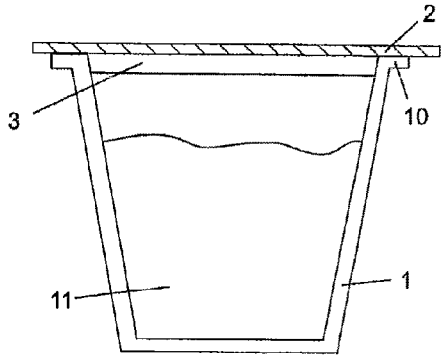
FIG. 2 is a cross-sectional view of a sealed package according to the invention.

FIG. 2 shows, in a cross-section, a package closed with a cover, in which only the profile 3 placed inside the package and enabling the resealing of the package is shown as a structural detail of the cover 2. A product 11 is packed in the closed space limited by the bottom part 1 and the cover 2 of the package. The bottom part 1 comprises the bottom of the package as well as side walls extending upwards from the bottom, their edges ending at an opening roll or a flange 10 encircling the edges of the bottom part. When the package is closed, the cover 2 is placed onto the opening roll or flange 10 at the top of the bottom part 1. In this area, the so-called sealing area, where the lower surface of the cover part 2 and the upper surface of the opening roll or flange 10 are against each other, the package can be closed by sealing. The downwards directed profile 3 on the lower surface of the cover 2 is placed inside the package when the package is sealed. If the profile 3 has a flat outer surface, the cover of the package is preferably provided with a tear-off flap 9 so that the cover can be easily opened by tearing off.

Figure 3:
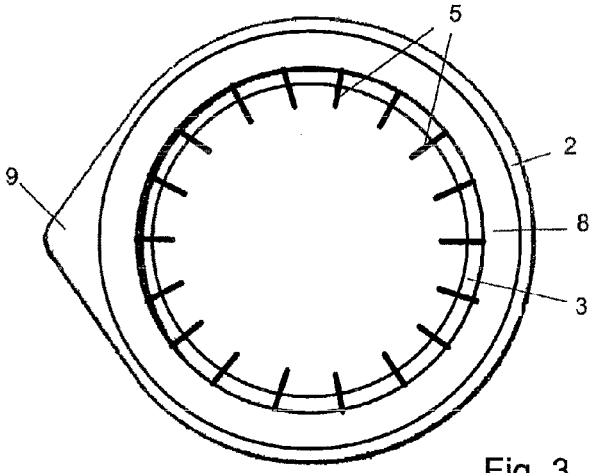
FIG. 3 shows the structure of a cover according to the invention, seen from the bottom.
Figure 4:
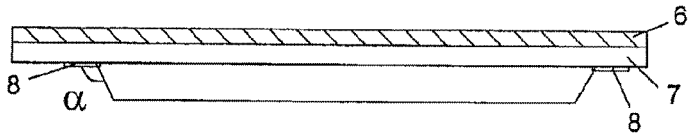
FIG. 4 is a cross-sectional view of a cover for the package shown in FIG. 2, having a downwards directed annular profile.

FIG. 3 shows the structure of the cover 2 according to the invention seen from the bottom, and FIG. 4 shows an embodiment of the structure of the cover 2 according to the invention in a cross-sectional view. FIG. 3 shows ribs 5 provided on the inner surface of the profile 3 and improving the attachment of the profile to the lower surface of the cover 2. FIG. 4 shows that the cover 2 consists of a cardboard or paper based layer 6 coated with a coating layer 7 on at least one side. The downwards directed profile 3 on the lower surface of the cover 2 has a flat outer surface, and it enables the resealing of the cover and centers the cover when the package is closed as well as provides the package with a good contact surface.

Figure 5:
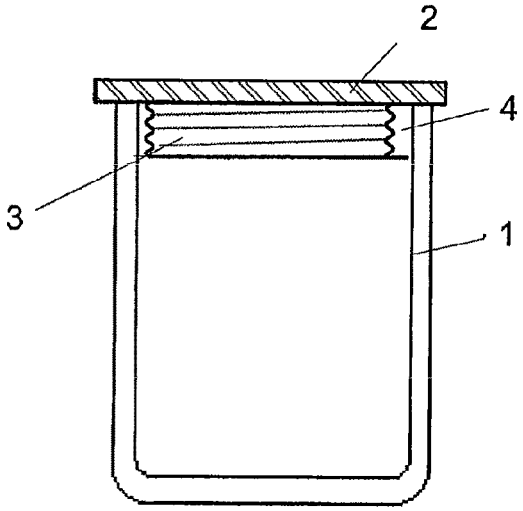
FIGS. 5 and 6 are cross-sectional views of a package according to another embodiment of the invention.
Figure 6:
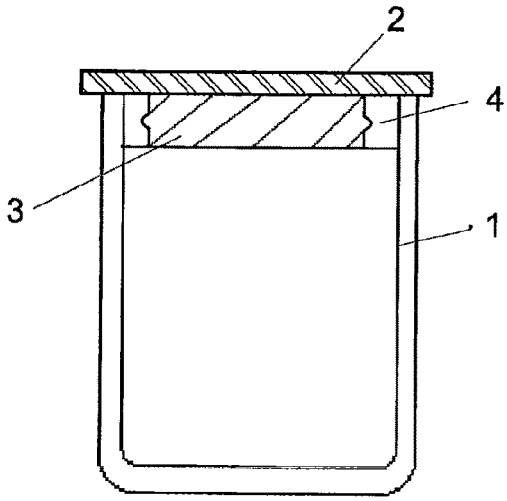

FIGS. 5 and 6 show cross-sectional views of a package according to a second embodiment of the invention, in which a threading or a sealing mechanism enabling a snap-on connection the outer surface of the downwards directed profile is formed on the lower surface of the cover 2. FIG. 5 shows a threaded profile 3 placed inside the package and enabling the resealing of the package. The upper edge of the bottom part 1 of the package has a counterpiece 4 for the threads in the profile 3; in other words, the counter-piece has so-called counter-threads. Thus, the package comprises the profile 3 of the cover with outer threads and the counterpiece 4 of the bottom part with inner threads.

FIG. 6 shows a package in which the sealing mechanism is a snap-on connection. The profile 3 of the cover and the counterpiece 4 of the bottom part are provided with counterparts for the snap-on connection, making the resealing of the cover possible. The snap-on connection may have a design that is different from the connection shown in the figure. When the snap-on connection is used as the sealing mechanism for the package, the cover of the package is preferably provided with a tear-off flap 9 to facilitate the opening of the package. The profile 3 shown in FIGS. 5 and 6 is placed against the counterpiece 4 on the inner surface of the bottom part when the package is closed.

Figure 7:
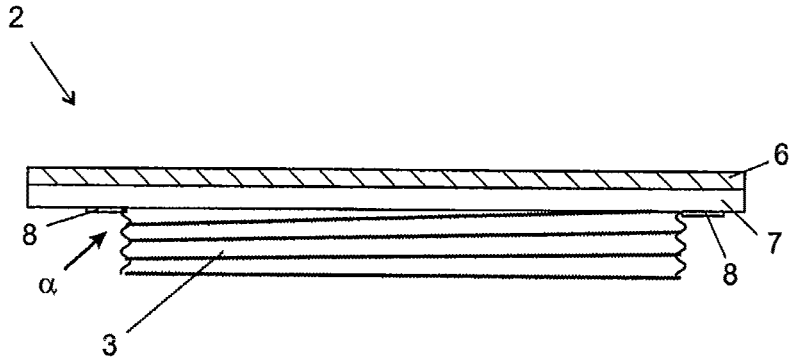
FIG. 7 is a cross-sectional view of a cover for the package shown in FIG. 5, provided with threads in the a downwards directed annular profile.
Figure 8:
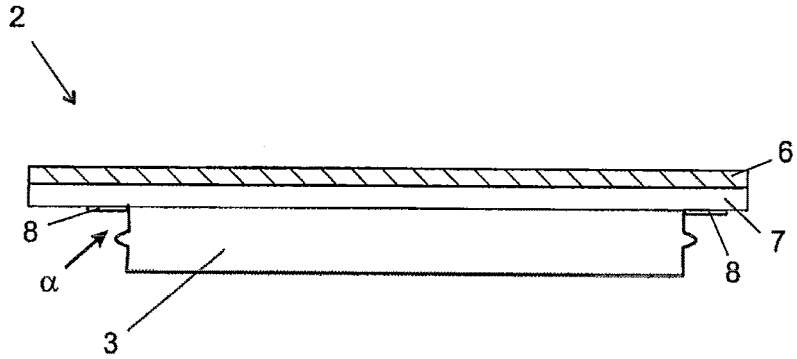
FIG. 8 is a cross-sectional view of a cover for the package shown in FIG. 6, having a snap-on connection in the a downwards directed annular profile.

FIG. 7 is a cross-sectional view on the structure of the cover 2 shown in FIG. 5. The cover 2 consists of a cardboard or paper based layer 6 covered with a coating layer 7 on at least one side. The lower surface of the cover 2 comprises a downwards directed profile 3 provided 3 with threads. FIG. 8, in turn, shows a cross-sectional view on the structure of the cover 2 shown in FIG. 6, the downwards directed profile having a snap-on connection.

The fibre material layer 6 of the cover 2 may consist of a cardboard or paper based material with a coating layer 7 on at least one side. Particularly in paper or paperboard based materials for food packages, the coating layers must act as barrier layers to prevent, on one hand, the leaking out of substances from the food through the package material and, on the other hand, the entry of substances into the package from the outside. Such materials added onto the outer and/or inner surface may be known barrier materials. For example, commonly used materials include polyethylene (PE) and polyethylene terephalate (PET) which are also heat-sealable materials and thus enable the sealing of the cover 2 to the bottom part 1. Other suitable coating materials include, for example, polyamide (PA) or ethyl vinyl alcohol (EVOH).

The use of fibre based materials in the cover enables the use of various printings on the cover, for example to improve the appearance of the package. Furthermore, the printings stay better on a cardboard or paper based material than on, for example, plastic material. Thus, for example date printings on the cover remain visible and do not wear off during transportation or as a result of use.

The profile 3 has the same shape and a diameter of the same size as the opening of the package to be sealed. In practice, the diameter of the profile is slightly smaller than the opening of the package to be sealed, so that the cover can be placed in position. For example, in a cup-shaped package, the outer diameter of the profile 3 is approximately equal to the inner diameter of the cup. The profile 3 has a thickness of about 0.2 to 2.0 mm; that is, the profile has an annular structure. The profile is not necessarily circular, but the shape of the profile will depend on the shape of the package to be closed. The profile 3 is normally equipped with ribs on its inner surface so that the structure of the profile is more rigid and the ribs 5 facilitate the firm attachment of the profile 3 to the lower surface of the cover 2. The ribs 5 may extend at intervals of, for example, 15 to 30 degrees, preferably 20 degrees, in the profile 3.

If the profile 3 has a flat outer surface, the angle $\alpha$ between the lower surface of the cover 2 and the outer edge of the profile 3 is preferably greater than 90 degrees. Thus, the upper part of the profile 3, attached to the lower surface of the cover 2, has a slightly greater diameter than the lower edge of the profile 3. For example, the angle $\alpha$ is about 96 degrees in a cup-shaped package, wherein the cover is easily placed inside the package when the package is sealed, because the profile 3 will follow the wall of the cup. The angle $\alpha$ and the diameter of the profile are preferably dimensioned so that the outer edge of the profile 3 matches with the inner surface of the package to be sealed. The angle $\alpha$ should be dimensioned so that the cover 2 can be pressed into place so that the lower surface of the cover 2 is placed onto the opening roll or flange 10 of the bottom part 1.

A cover equipped with a threaded or snap-on connection is used primarily in packages, in which the angle $\alpha$ between the lower surface of the cover 2 and the outer edge of the profile 3 is 90 degrees; in other words, the diameter or diagonal of the bottom part of the package is the same as the diameter or diagonal of the opening of the package. The snap-on connection can also be used in a cup-like package, in which the diameter of the bottom is smaller than the diameter of the opening. In this case, the angle $\alpha$ between the lower surface of the cover 2 and the outer edge of the profile is preferably greater than 90 degrees.

The profile 3 and the counterpiece 4 may be made of any injection mouldable material which adheres to the coating 7 on the lower surface of the cover 2 and meets the requirements set for the product, for example food compatibility. The injection mouldable material may be any suitable polymeric material, such as thermoplastic or thermoelastic. Examples of suitable polymers include polyolefins, polyesters and polyamides. The plastic material may also be modified in view of this use. The profile 3 and the counterpiece 4 may also be made of a biodegradable plastic, such as one of the following: polylactide (PLA), biodegradable polyester, starch-based plastics or polyhydroxy alkanoates, particularly PHB plastic.

On the lower surface of the cover 2, a thin plastic layer may be added between the outer edge of the cover and the downwards directed profile 3, in the so-called sealing area. The aim of this layer of a plastic material is to improve the sealing and tightness properties of the cover 2, when the cover 2 is sealed to the bottom part 1 of the package. In the selection of the material for the plastic layer, the method used for sealing the package is taken into account. The plastic layer may be made of, for example, a heat-sealable material, such as polyethylene (PE) or polypropylene (PP). The materials for the plastic layer may also be selected so that it is possible to use, for example, ultrasonic sealing, high-frequency sealing, induction sealing, or microwave sealing.

When an extra plastic layer 8 is added into the cover, it is also possible to use such coating layers 7 in the cardboard or paper based materials of the cover 2 that are not sealable to the bottom part of the package; for example, it is possible to use coatings selected specifically on the basis of barrier properties.

The materials of the plastic layer 8 may be used to have an effect on the openability of the package. If no extra plastic layer 8 is added, the materials of the coating layer 7 must be sealable, and they affect the openability of the package. It is also possible to add wax, lacquer or another corresponding substance to the sealing area of the package to improve the opening properties of the package. Thus, the package will be easier to open by tearing off. The openability of the package can also be influenced by the materials used in the bottom part 1 of the package and by the selection of the sealing mechanism.

Both the profile 3 and the plastic layer 8 between the outer edge of the cover 2 and the downwards directed profile 3 may also contain a laser radiation absorbing additive which enables the sealing of the package by using, for example, a diode laser, an Nd:YAG laser or a fibre laser. Alternatively, the coating on the bottom part of the package may contain an absorbent, wherein the sealing of the package by a laser is possible without an addition of the absorbent into the materials of the cover part.

It is also possible to admix an oxygen absorber to the material of the profile 3, to remove the oxygen remaining in the package after the sealing of the package. Thus, the profile 3 of the package can be formed by injection moulding of a plastic material that contains an oxygen absorber. Alternatively, a separate insert that contains an oxygen absorber can be placed in the profile 3. The plastic material that contains an oxygen absorber may be a common non-degradable plastic or any above-mentioned biodegradable plastic.

The resealable cover according to the invention is made by a method, in which the cover 2 is generally cut from a web consisting of a cardboard or paper based layer 6 coated with a coating layer on at least one side. After the cover 2 has been cut to its shape, a downwards directed profile 3 is formed on its lower surface by injection moulding. Furthermore, a thin plastic layer 8 can be formed by injection moulding on the lower surface of the cover 2, between the outer edge of the cover 2 and the downwards directed profile 3.

The moulding of the profile 3 onto the lower surface of the cover part is performed by placing the cover part 2, cut to its shape, in the mould of the injection moulding machine so that the lower surface of the cover 2 is against the injecting side, after which the profile 3 is formed by injection moulding. The injection mould to be used may be in a carousel-type device comprising several identical moulds, one at a time receiving a cardboard cover, onto which the profile 3 is moulded, and after circulating through different steps, putting out a cover 2 containing a ready profile 3 for further processing.

If the plastic layer 8 is made of the same material as the profile 3, it can be moulded simultaneously with the profile 3.

The plastic layer 8 and the profile 3 can also be formed of two different components, wherein a so-called multi-component injection moulding is applied. After the step of injection moulding of the profile 3, the cover is removed from the mould, and separate finishing steps will not be needed, if hot channels and nozzles are applied. Otherwise, the injection moulding step is followed by a finishing step to remove the git.

The counterpiece 4 attached to the upper edge of the bottom part 1 of the package is made separately of plastic, and it is attached to the inner surface of the bottom part 1 of the package. The counterpiece can also be made directly by injection moulding onto the bottom part of the package.

The invention also relates to a package closed with a cover made by an invention and to a method for sealing a package. In the package, the down-wards directed profile that enables the resealing of the cover 2 is placed inside the bottom part 1 of the package when the package is sealed. The sealable package is preferably made of coated cardboard or paper, but the package may be made of any material that can be provided with a cover by sealing. For example, the package may be made of various plastic materials.

In the materials of the package, it is also possible to take into account that the materials forming the cover 2 and the bottom part 1 are suitable for modified atmosphere packaging (MAP). In this case, the joined bottom part 1 and cover 2 limit an airtight inner space within them, where a product 11, for example food, is packed, and the inner part of the package may also contain a suitable gas composition. In MAP packages, the plastic layer 8 added onto the lower surface of the cover 2 also plays a great role, so that the cover 2 can thus be tightly sealed to the bottom part 1.

The packages may also have other shapes than the cup-shaped packages shown in FIGS. 1, 2, 5 and 6 above. The covered package may be, for example, a cup, a box, a tin, a mug, or a beaker that contains for example food, such as prepared food. Preferably, the package is cup-shaped, but the above-described cover according to the invention and the method for manufacturing the cover do not set limits to the shape of the cover or the package. The shape of the package is also affected by the sealing mechanism used.

Threads or a snap-on connection formed in the profile 3 of the cover and in the counterpiece 4 of the bottom part make it possible to reseal the package tightly. The threads are designed in the profile 3 and the counterpiece 4 so that the package can be easily sealed in the packaging process, and by means of the threads, the package can also be tightly resealed after its opening. In the design of the snap-on connection, the openability of the package is also taken into account.

The package is sealed by attaching the cover 2 of the package to the bottom part 1 so that the downwards directed profile 3 of the cover 2 is placed inside the package. The cover 2 is joined to the bottom part 1, for example, by heat-sealing, ultrasonic sealing, laser, or by another sealing method. The selection of the suitable sealing method is affected by the materials used in the coating layer 7, the plastic layer 8 of the cover, and the materials used in the bottom part 1 of the package. In the sealing step, the coating layer 7 or the plastic layer 8 on the lower surface of the cover 2 is sealed to the opening roll or flange 10 of the bottom part 1. Thus, the profile 3 remains inside the tight seam, and it is not sealed to the package, so that the cover can be opened easily when the package is opened for the first time. The above-described method for sealing the package can be easily integrated in the rest of the automated packaging process.

Sealing of the package with laser is possible when the profile 3 or the coating layer 8 on the lower surface of the cover 2 contains an absorbent, that is, an additive that absorbs laser radiation. Alternatively, the coating on the bottom part of the package to be sealed may contain an absorbent, wherein the sealing of the package by laser is possible without adding the absorbent to the materials of the cover part. The sealing of the package with laser is performed at the upper surface of the cover 2, and the cover 2 is attached to the opening roll or flange 10 of the bottom part in the same way as in the other sealing methods. Alternatively, the sealing of the package can be performed at the side of the package, at the top of the bottom part 1, if an absorbent was added to the profile 3. In this case, the package is sealed by a seam between the profile 3 and the bottom part 1.

If the profile 3 is provided with threads, the cover 2 does not necessarily need to be sealed to the bottom part 1 of the package as presented above, but the threaded joint as such makes it possible to close the cover 2 tightly. Preferably, the cover 2 equipped with a threaded profile is sealed to the bottom part 1 of the package at some points, to secure that the cover is fastened, and thus the package remains easy to open. Furthermore, it can be seen from the package when the package is opened for the first time.

In the above-presented methods for sealing a package, the product to be packed is first placed in the bottom part 1 of the package, and the cover 2 according to the invention is then placed in the package, after which the cover 2 is sealed to the bottom part 1 by any of the above-described methods. It is also possible that the package is filled with the product to be packed through the bottom. In this case, the bottom part 1 first contains only the walls of the bottom part, to which the cover 2 is sealed by the above-described methods. After this, the package is filled with the product to be packed through the opening at the bottom, and the package is then closed by joining a bottom to the walls of the bottom part or by sealing the walls of the package to each other. This is possible particularly in packages made of cardboard or paper based materials.

Even though the sealing of food packages has been described above, the invention can also be used for the sealing of packages containing other products. The invention is thus not intended to be limited to the package shapes or materials presented as examples above, but the invention is intended to be applied widely within the scope of the inventive idea defined in the appended claims.

The invention claimed is:

1. A cardboard cover adapted for sealing and resealing a package, which comprises a cardboard or paper based layer containing a coating layer on at least one side thereof, a downwardly directed profile member disposed on a lower surface of the cardboard cover and extending into the package when the package is closed by said cover, a heat-sealable plastic layer disposed on the coating layer and extending between the outer edge of the cover and terminating at the downwardly directed profile member on the lower surface of the cover, and a lacquer or wax disposed as a separate layer between the outer edge of the cover and the downwardly directed profile member on the lower surface of the cover, wherein an annular profile of said downwardly directed profile member is formed on the coating layer on the lower surface of the cardboard or paper layer, by injection moulding.

2. The cover according to claim 1, wherein the inner surface of the downwardly directed profile member contains ribs.

3. The cover according to claim 1 or 2, wherein the outer surface of the profile member is provided with threads or a sealing mechanism that enables a snap-on connection.

4. The cover according to claim 1, wherein the profile member is made of biodegradable plastic.

5. The cover according to claim 1, wherein the downwardly directed profile member and/or the plastic layer contains an additive that absorbs laser radiation.

6. A method for manufacturing a cardboard cover that seals and reseals a package which comprises forming the cardboard cover by coating a cardboard or paper based layer with a coating layer on at least one side thereof, forming a downwardly directed profile member which is adapted to be placed inside the package when the package is closed, on a lower surface of the cardboard cover and providing a heat-sealable plastic layer on the coating layer and between the outer edge of the cover-and terminating at the downwardly directed profile member on the lower surface of the cover, and a lacquer or wax disposed as a separate layer between the outer edge of the cover and the downwardly directed profile member on the lower surface of the cover, wherein the downwardly directed annular profile member is formed on the coating layer disposed on the lower surface of the cardboard layer, by injection moulding.

7. A package having a bottom part and a cardboard cover for sealing and resealing the package, said cardboard cover comprising a cardboard or paper based layer containing a coating layer on at least one side thereof, a downwardly directed profile member disposed on a lower surface of the cardboard cover and extending into the package when the package is closed by said cover and a heat-sealable plastic layer disposed on the coating layer and extending between the outer edge of the cover and terminating at the downwardly directed profile member on the lower surface of the cover, and a lacquer or wax disposed as a separate layer between the outer edge of the cover and the downwardly directed profile member on the lower surface of the cover, wherein an annular profile of said downwardly directed profile member is formed on the coating layer on the lower surface of the cardboard or paper layer, by injection moulding and said bottom part containing an annular member which is adapted to engage said profile member.

8. The package according to claim 7, wherein a threaded or snap-on engaging connection is formed on the outer surface of the profile member and a counterpiece for engaging the threaded or snap-on connection of the profile member of the cover is provided as an annular member inside the bottom part of the package.

9. The package according to claim 8, wherein the counterpiece of the bottom part is a separate ring attached to the upper edge of the bottom part of the package and inside the bottom part or the counterpiece of the bottom part is made by injection moulding directly onto the bottom part.

10. The package according to claim 7, 8 or 9, wherein the bottom part is made of a paper, a cardboard based material or a plastic.

11. The package of claim 8, wherein the snap-on, engaging connection comprises only a single male-female connection between the profile member of the cover and the annular counterpiece provided inside the bottom part of the package.

12. The package of claim 8 wherein the threaded, engaging connection comprises only a threaded connection between the profile member of the cover and the annular counterpiece provided inside the bottom part of the package.

13. A method for sealing a package that contains a product, whereby a cardboard cover which contains a downwardly directed profile member on a lower surface of the cover is attached to a bottom part of the package in such a way that the profile extends into the package, wherein the cardboard cover which contains the profile member is attached to the bottom part by sealing it with the application of a heat sealable plastic layer in the area between an outer edge of the cover and terminating at the downwardly directed profile member, or the cover is attached to the bottom part by sealing the profile member to the bottom part, wherein a lacquer or wax is disposed as a separate layer between the outer edge of the cover and the downwardly directed profile member on the lower surface of the cover.

14. The method according to 13, wherein the profile member is sealed to the bottom part by using a laser.

* * * * *